US005319862A

United States Patent [19]

Ohgihara

[11] Patent Number: 5,319,862

[45] Date of Patent: Jun. 14, 1994

[54] METHOD OF AND APPARATUS FOR MANUFACTURING A MAT FOR BUILDING PURPOSE

[75] Inventor: Katsuyuki Ohgihara, Tokyo, Japan

[73] Assignee: Sanei-Kisetsu Co., Ltd., Tokyo, Japan

[21] Appl. No.: 34,278

[22] Filed: Mar. 22, 1993

[51] Int. Cl.[5] ..... F26B 7/00

[52] U.S. Cl. ..... 34/311; 34/242; 34/216; 266/179; 432/144

[58] Field of Search ..... 34/242, 7, 23, 155, 34/162, 236, 216, 217; 277/135; 162/371; 266/179; 432/144

[56] References Cited

U.S. PATENT DOCUMENTS

| | | | |
|---|---|---|---|
| 4,028,051 | 6/1977 | Lundstroem | 432/144 |
| 4,787,641 | 11/1988 | Rautakorpi et al. | 34/242 |
| 4,825,561 | 5/1989 | Cornell | 34/242 |

*Primary Examiner*—Denise Gromada
*Attorney, Agent, or Firm*—Flynn, Thiel, Boutell & Tanis

[57] ABSTRACT

A method of and an apparatus for drying/curing a dry material such as a mat of fibrous or powder material as may be used for building purpose as well as a non-dry material such as a thermosetting resin are disclosed. The disclosure relates to the sealing function during the drying/curing step. The apparatus comprises a heating and blowing mechanism for drying/curing a mat as it is being conveyed by a conveyor mechanism including pair of upper and lower conveyors, and shield mechanism for shielding between the conveyor mechanism and the heating and blowing mechanism. The shield mechanism includes wire brushes on blowing boxes of the heating and blowing mechanism for abutment against caterpillar plates of forward runs of respective conveyors to seal between the caterpillar plates of the forward runs and the blowing boxes. Any powder or particles which may be developed during the drying-/curing step is trapped by the wire brush, which is then effective to prevent a leakage of a hot air, thus assuring an even pressure of hot air supplied. The wire brushes are disposed in a plurality of rows and divided into stationary and movable ones. By moving the movable wire brushes for movement toward or away from abutment against the caterpillar plates of the forward runs, selected flexible caulking members are operated to provide a variable shielded width.

7 Claims, 7 Drawing Sheets

METHOD OF AND APPARATUS FOR MANUFACTURING A MAT FOR BUILDING PURPOSE

FIELD OF THE INVENTION

1. Background of the Invention

The invention relates to a method of and an apparatus for drying/curing dry materials such as mats of fibrous or powder material as may be used for building purpose as well as a non-dry material such as thermosetting resin, and in particular, a method of and an apparatus for manufacturing a mat used for building purpose which is characterized in the seal for hot air thereof during the drying/curing step.

2. Description of the Prior Art

Generally, a molded mat used for building purpose is subject to a drying or curing step in a drier before it is finished to a final product. A band drier is typically used at this end.

A conventional band drier comprises a pair of oppositely disposed, upper and lower conveyers, each of which is housed in an upper or lower oven. Each conveyor comprises an endless chain disposed to run around a pair of sprockets and having a plurality of caterpillar plates with ventilation openings formed therein mounted thereon. A drive sprocket is driven for rotation by a drive source in each of the conveyors, and the mat is held between and conveyed by the forward runs of caterpillar plates of the respective conveyors as the sprockets rotate.

A heating and blowing mechanism is disposed above and below the caterpillar plates of the forward runs of the upper and lower conveyors, and operates to introduce a hot air from a heated source into the associated oven by means of a blower, and to cause it to circulate through the caterpillar plates of the respective forward runs and the mat being conveyed, thereby drying/curing the mat. The heating and blowing mechanism comprises a series of alternately arranged high and low pressure blowing boxes which are disposed along the direction of conveyance between the caterpillar plates of the forward and the return run of each conveyor, and a path for the hot air is defined by a high pressure blowing box and a corresponding low pressure blowing box of respective conveyors. The upper conveyor and upper blowing boxes are vertically adjustable in accordance with the thickness of the mat.

A conventional band drier may be exemplified by an arrangement disclosed in U.S. Pat. No. 4,028,051 in which narrow paths are provided between the caterpillar plates and the blowing boxes in order to increase a pressure differential between the high and the low pressure blowing box so that the passage of the hot air through the mat is facilitated, thereby assuring an even drying/curing of both the front and the rear side of the mat.

These narrow paths are provided to prevent damages by thermal distortion occurred in a sliding movement between a fixed side and a movable side. Such provision of narrow paths inevitably makes a clearance between the caterpillar plates and the blowing boxes, thus inviting a leakage of hot air from the heating and blowing mechanism. To reduce the leakage, it is necessary to make the clearance as small as possible. However, such a clearance in the narrow paths has to be provided at the range from 5 mm to 10 mm at least. It is said in general that according to such manner, 10 to 20 percent of the hot air leaks out as ineffective hot air.

The hot air usually assumes an elevated temperature in a range from 100° C. to 350° C., and accordingly, the narrow paths may be degraded by thermal effect or may be subject to a thermal distortion to enlarge the leak clearance, whereby the hot air may find its way out of the circulation path into the oven to allow the ingress of dusts produced by the mat material into the drive section of the conveyor, causing malfunctioning thereof. In addition, a failure to maintain a given hot air pressure causes a reduced efficiency, or may cause an inconvenience that the mat cannot be dried and cured in an even manner.

In addition, a predetermined and fixed interval between the narrow paths inevitably determines the effective width of the cured mat to a given length. For example, when a mat which is shorter in width than the effective width of the caterpillar plates is conveyed, the hot air can freely pass through a part of the caterpillar plates on which the shorter mat is not contact with, thus inviting a reduction of the hot air for circulating through the mat. Accordingly when the cured mat is cut to the size of desired final product, a wasteful edge may be produced during an edge trim step, thus decreasing the production efficiency.

SUMMARY OF THE INVENTION

Accordingly, it is a first object of the invention to provide a method of and an apparatus for manufacturing a mat for building purpose which avoids a leakage of a hot air from the circulation path to ensure the sealing between a fixed side and a movable side in conveyance by means of removing a problem of thermal distortion and which allows an even drying/curing of a mat.

It is a second object of the invention to provide a method of and an apparatus for manufacturing a mat for building purpose in which an interval between seals is variably selected crosswise in accordance with the width of the cured mat so that the mat may be dried and cured to a desired effective width.

The first object mentioned above is accomplished by providing a flexible caulking member between each of the caterpillar plates of the forward run and the heating and blowing means so that the caulking member traps particles and powder which may be produced during the drying/curing step, thus preventing the leakage of the hot air.

The second object mentioned above is accomplished by allowing a choice of the flexible caulking member to change its crosswise position so that the drying/curing step may be effected in accordance with the width of the final mat to be used for building purpose.

Other objects and advantages of the invention will become apparent from the following description with reference to the attached drawings.

DETAILED DESCRIPTION OF PREFERRED EMBODIMENT

Figure 1:
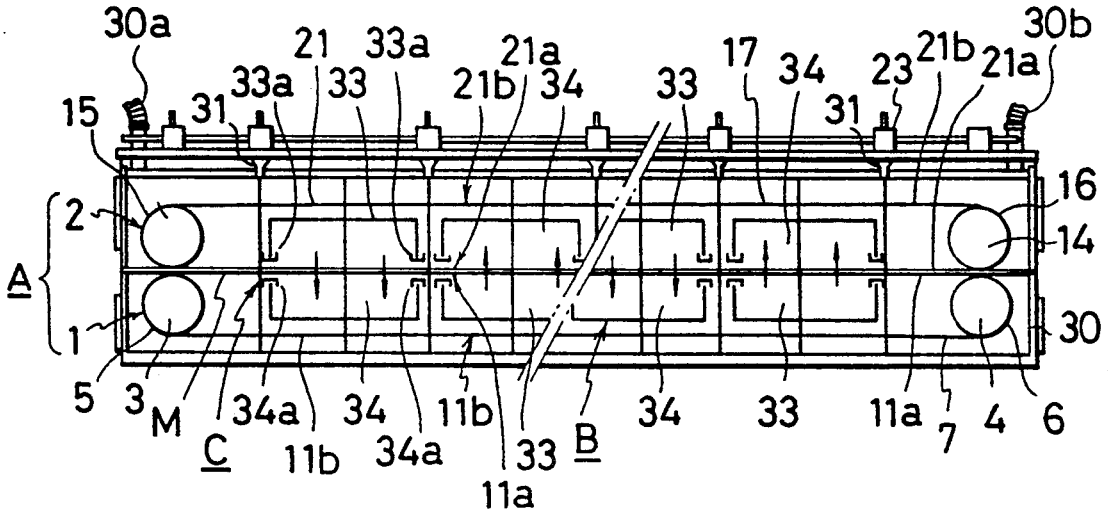
FIG. 1 is a longitudinal section of an apparatus for manufacturing a mat for building purpose according to one embodiment of the invention, taken along the direction of conveyance.

Referring to the drawings, the invention will now be described in terms of an embodiment shown. An apparatus for manufacturing a mat for building purpose comprises a conveyor mechanism A acting as conveying means, a heating and blowing mechanism B acting as heating and blowing means which dries and cures a mat as it is conveyed by the conveyor mechanism A, and a shield mechanism C acting as shield means to provide an isolation between the conveyor mechanism A and the heating and blowing mechanism B.

Figure 2:
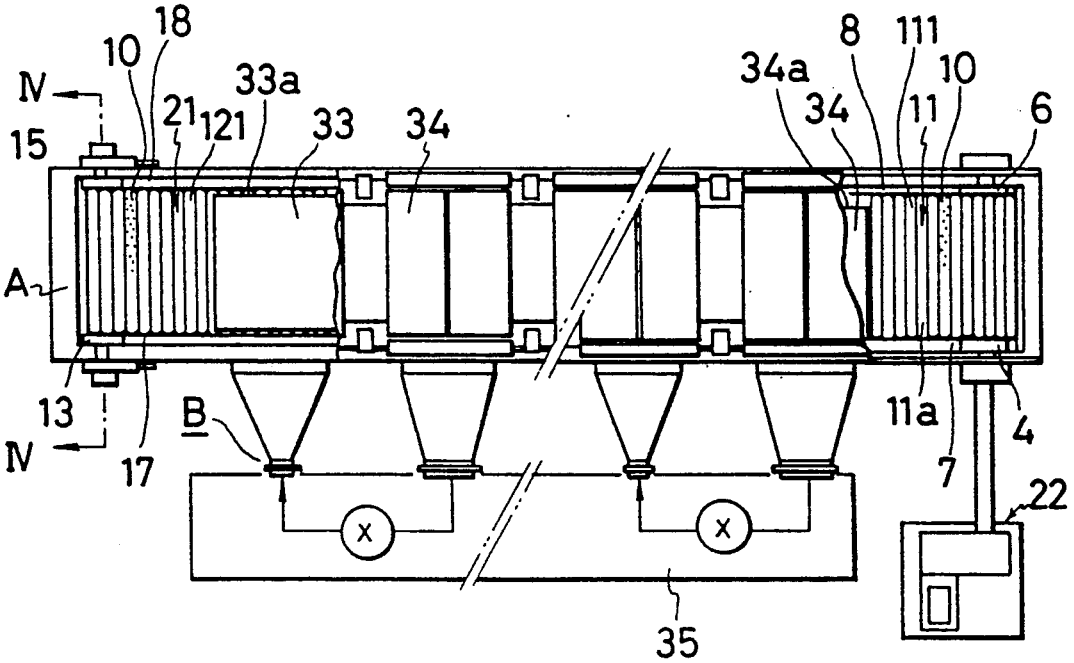
FIG. 2 is a top view, partly broken away, of the apparatus shown in FIG. 1.
Figure 3:
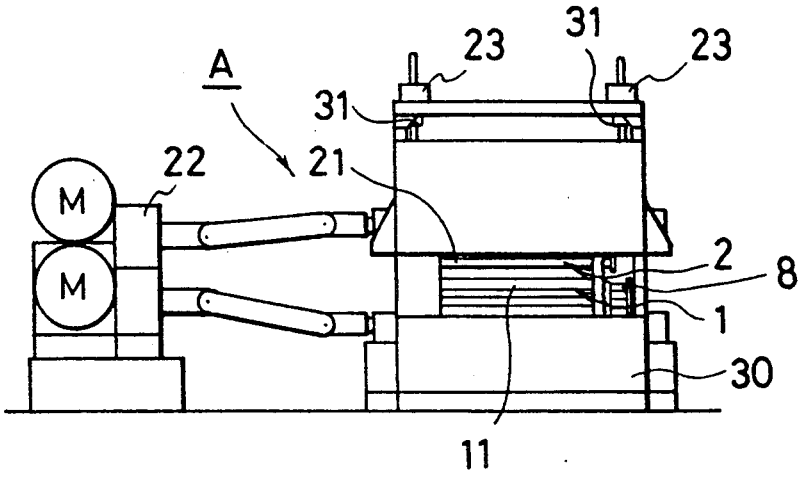
FIG. 3 is a front view of the apparatus.

As shown in FIGS. 1 to 3, the conveyor mechanism A comprises a lower conveyor 1 and an upper conveyor 2, which are received in an oven 30, respectively. The lower conveyor 1 comprises a pair of lower sprockets 4, 6 connected to a drive source 22, a pair of follower sprockets 3, 5 and a pair of endless lower chains 7, 8 extending across the driven sprockets and the follower sprockets, with a multiplicity of caterpillar plates (strut plates) 11 having ventilation openings 10 perforated therein extending across the endless chains 7, 8. Similarly, the upper conveyor 2 comprises a pair of upper sprockets 14, 16 connected to the drive source 22, a pair of follower sprockets 13, 15, and a pair of endless upper chains 17, 18 extending across the driven sprockets and the follower sprockets, with a multiplicity of caterpillar plates having ventilation openings 10 perforated therein mounted across the pair of upper chains 17, 18. In addition, the upper conveyor 2 is vertically elevatable together with associated upper high pressure and low pressure blowing boxes 33, 34 by means of an upper conveyor elevating unit 31, shown in FIG. 3.

Figure 4:
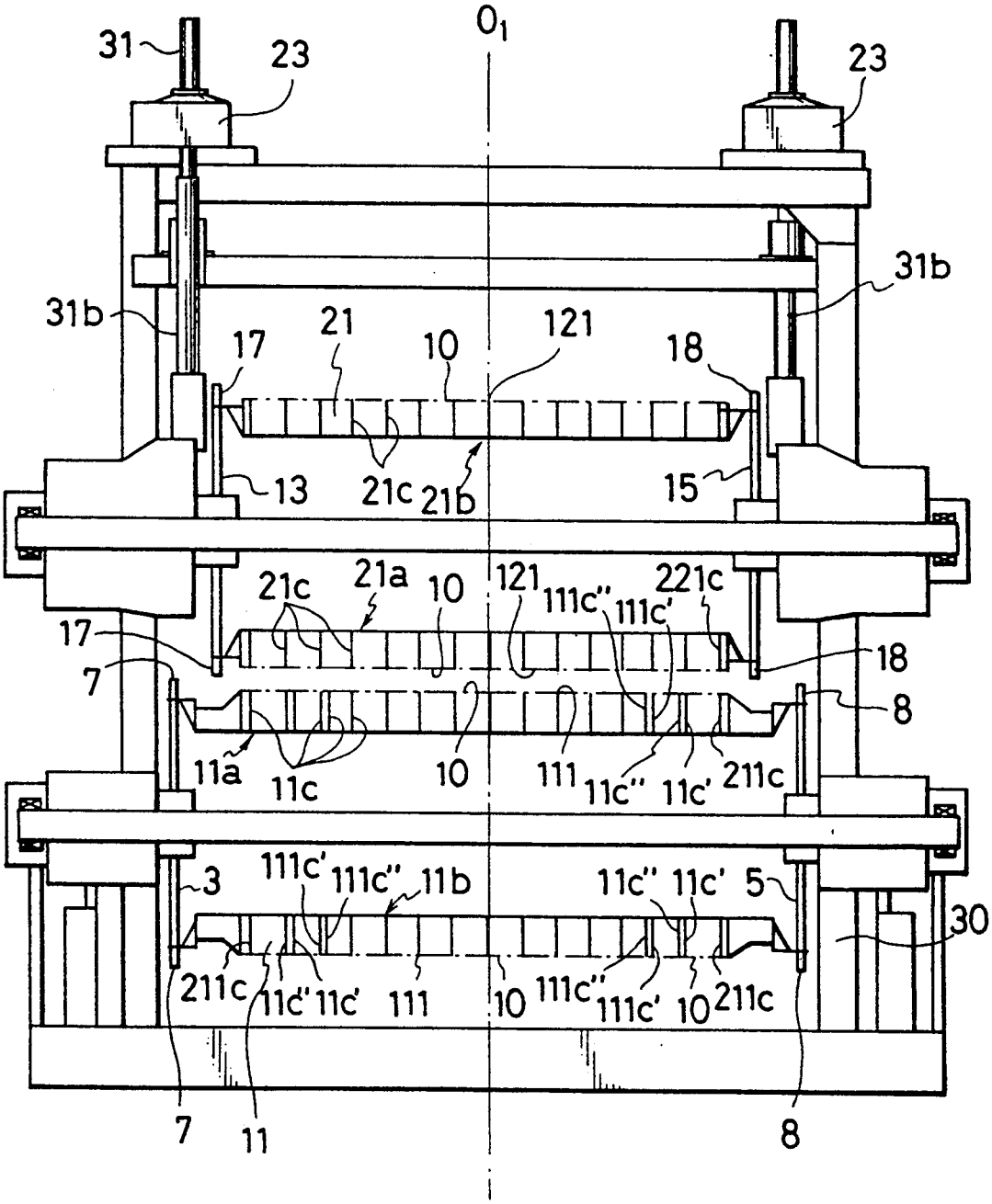
FIG. 4 is a cross section of the apparatus shown in FIG. 2, taken along the line IV—IV.

As shown in FIG. 4, each of the caterpillar plates 11, 21 comprises a plate section 111, 121 in which a plurality of ventilation openings 10 are formed, and the underside of the plate section 111, 121 is formed with a plurality of reinforcing ribs 11c, 21c which extend parallel to the direction of conveyance. Of these reinforcing ribs 11c, 21c, a reinforcing rib 221c on the upper conveyor 2 which is located outermost and a corresponding reinforcing rib 211c of the lower conveyor 1 are vertically aligned to assume crosswise equivalent positions. The reinforcing ribs 221c, 211c are respectively provided to be slightly offset in the direction of width in order to avoid an interference between the front and rear reinforcing ribs 11c, 21c when the caterpillar plates 11, 21 are turning reversely, thus allowing a smooth turn thereof. Reinforcing ribs 11c', 11c'', 111c', 111c'' of the lower conveyor 1 are symmetrically disposed with respect to a center line $0_1$ and are also located at slightly offset positions in width on each of the front and rear plate sections 111, 121. Those portions of the caterpillar plates 11, 21 which face each other define forward traveling runs 11a, 21a while the remainder define return traveling runs of caterpillar plates 11b, 21b. A reduction gearing 23 is shown to reduce the speed with which the conveyors 1, 2 are driven in order to control the speed of conveyance in accordance with the material and the thickness of a mat being processed.

As the respective conveyors 1, 2 are driven and the drive is transmitted through the reduction gearing to the lower sprockets 3, 5 and the upper sprockets 13, 15 to drive them for rotation in the opposite directions to each other, a mat M for building purpose which is conveyed from the outside is introduced into an opening defined between the forward runs of the caterpillar plates 11a, 21a to be conveyed as held sandwiched therebetween.

Figure 5:
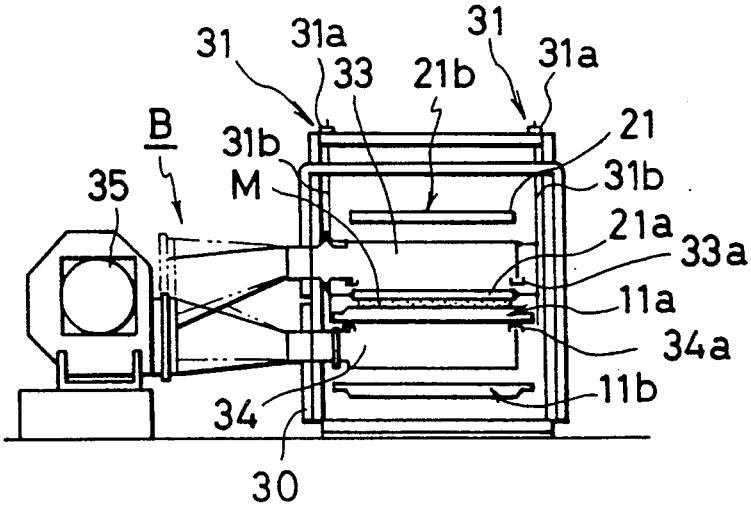
FIG. 5 is an illustration of a heating and blowing mechanism of the apparatus.

The heating and blowing mechanism B is shown in FIG. 5 as comprising a heating blower unit 35 which blows heated air supplied from a heated source, not shown, and high pressure and low pressure blowing boxes 33, 34. As shown in FIGS. 1 and 2, the high pressure and the low pressure blowing box 33, 34 are alternately disposed along the direction of conveyance between the forward run of caterpillar plates 11a, 21a and the return run of caterpillar plates 11b, 21b of each conveyor 1 or 2 so that the hot air from the blower unit 35 may be admitted to the oven 30. By defining a path for the hot air by utilizing the high pressure blowing boxes 33 and the low pressure blowing boxes 34 of the respective conveyors, the heating and blowing mechanism B constitutes a hot air supply system which causes the hot air to circulate between the heated blower unit 35 and the respective blowing boxes 33, 34. The hot air delivered from the blower unit 35 is fed from the high pressure blowing box 33 to pass through the caterpillar plates 11a, 21a of the forward runs and through the mat M being conveyed into the low pressure blowing box 34 which has its opening located opposite to the high pressure blowing box 33.

Figure 9:
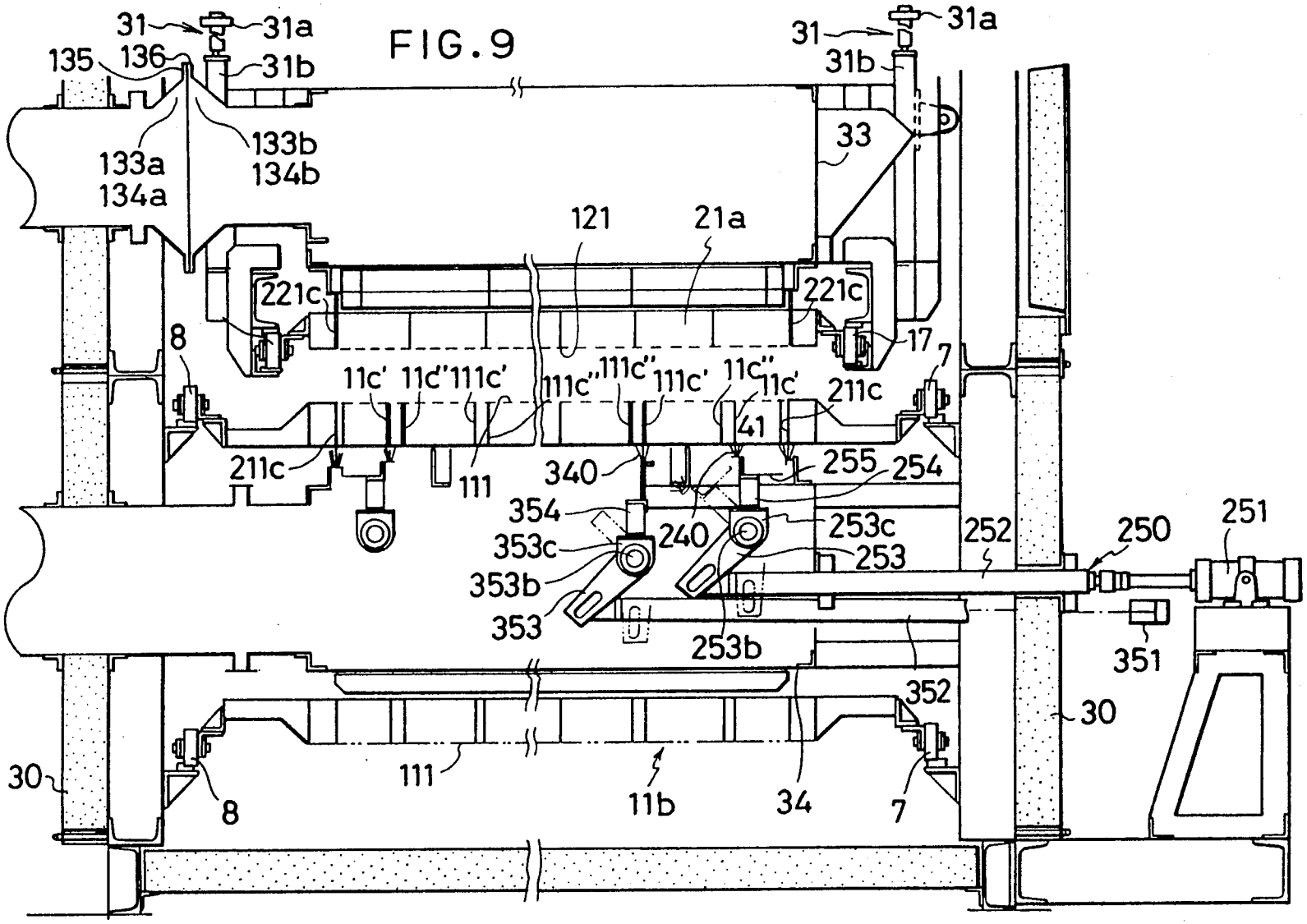
FIG. 9 is an illustration of a caulking member rocking assembly of the shield mechanism.

As shown in FIG. 9, the upper high pressure and low pressure blowing boxes 33, 34 disposed in the upper conveyor 2 has movable supply and exhaust openings 133b, 134b respectively which are vertically elevatable to and connected with each of the other supply and exhaust openings 133a, 134a of a fixed side of the heating and blowing mechanism B. The movable supply and exhaust openings 133b, 134b and the fixed supply and exhaust openings 133a, 134a are formed with plates 135, 136 extending upwardly and downwardly which are slidably contact against each other so as to be connected with the movable openings 133b, 134b and the fixed openings 133a, 134a. As shown in FIG. 1, exhaust ducts 30a, 30b are disposed on the upper portion of the oven 30. When a waste gas leaked out from both lateral side faces of the mat M during the drying/curing step is accumulated inside the upper side of the oven 30, the waste gas is exhausted outside through the exhaust ducts 30a, 30b.

Figure 6:
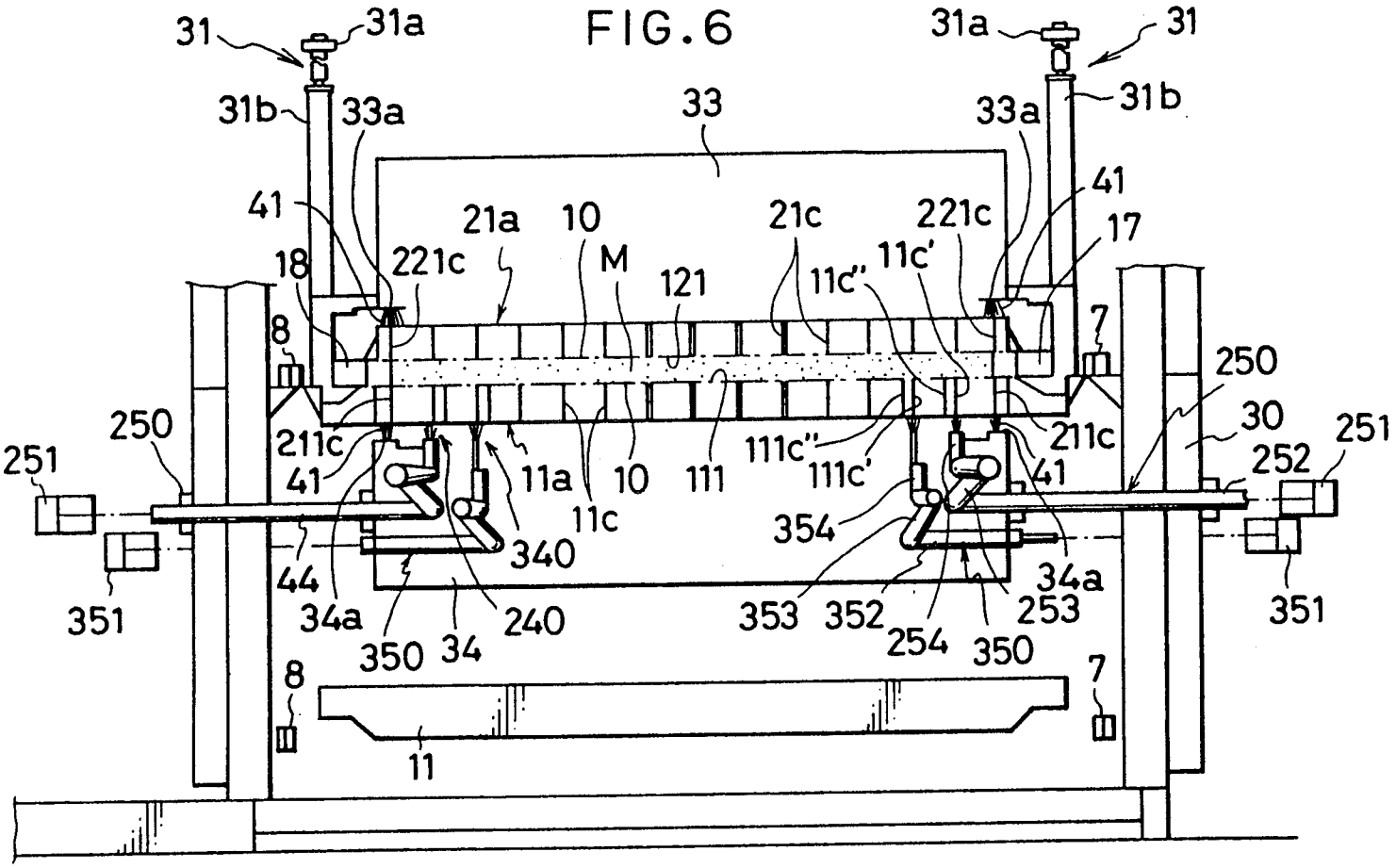
FIG. 6 is a transverse cross section of a shield mechanism of the apparatus.

As shown in FIGS. 5 and 6, the upper conveyor elevating unit 31 is provided on the oven 30 to extend through its upper portion. The upper conveyor elevating unit 31 comprises jacks 31a disposed on the upper portion of the oven 30 and upper conveyor supporting rods 31b extending downward from the jacks 31a. The upper conveyor supporting rods 31b, which are firmly connected with the upper conveyor 2 and the upper blowing boxes 33, 34 included in the upper conveyor 2, vertically elevate them in responsive to the actuation of the jacks 31a.

Figure 7:
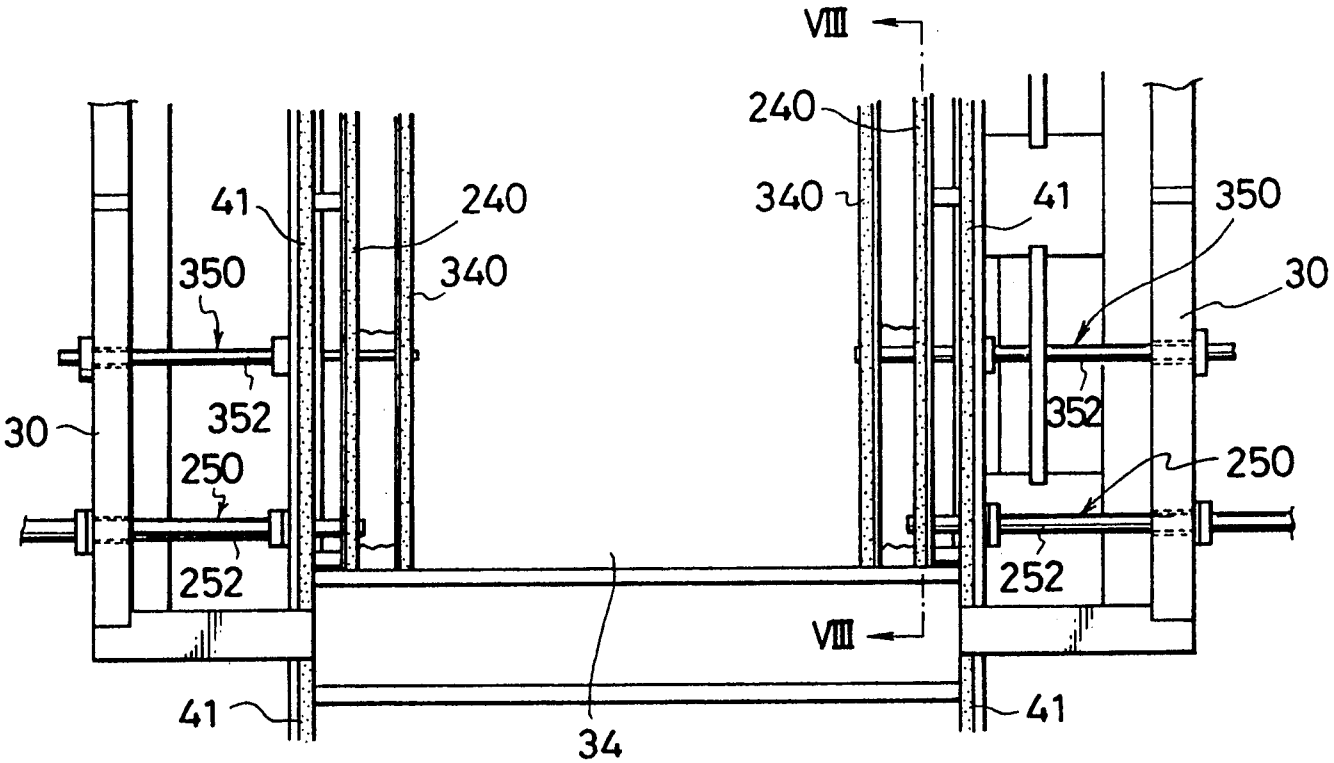
FIG. 7 is a transverse cross section of part of the shield mechanism shown in FIG. 6.

In accordance with the invention, a shield mechanism C which prevents a leakage of the hot air from between the conveyor mechanism A and the heating and blowing mechanism B to the outside is provided within the heating and blowing mechanism B. Referring to FIGS. 6 and 7, the shield mechanism C comprises first wire brushes 41 which are provided as stationary flexible caulking members, second and third wire brushes 240, 340 which are provided as movable flexible caulking members located inward of the first wire brushes 41 for the lower conveyor 1 at different crosswise positions and extending along the direction of conveyance, and a plurality of rocking assemblies 250, 350 for causing an independent rocking movement of the second and the third wire brushes 240, 340 for movement toward and away from abutment against the caterpillar plates of the forward run 11*a* of the lower conveyor 1.

Referring to FIG. 6, the first wire brushes 41 are disposed at the opening edges 33*a*, 34*a* of the blowing boxes 33, 34, and abut against the reinforcing ribs 211*c*, 221*c* of the caterpillar plates 11*a*, 21*a* of the respective forward runs so as to fill the clearances between the blowing boxes

33, 34 and the caterpillar plates of the forward runs 11*a*, 21*a*. Referring to FIG. 7, the second and the third wire brushes 240, 340 are disposed inwardly of the first wire brushes 41 associated with the lower conveyor 1 at different crosswise positions so as to avoid an interference of each other, and extend along the direction of conveyance. In addition, the second and the third wire brushes 240, 340 are independently driven for rocking movement by the rocking assemblies 250, 350 so as to be movable toward or away from abutment against the plurality of reinforcing ribs 11*c*', 11*c*'', and 111*c*', 111*c*'' of the caterpillar plates 11*a* of the forward run.

Figure 8:
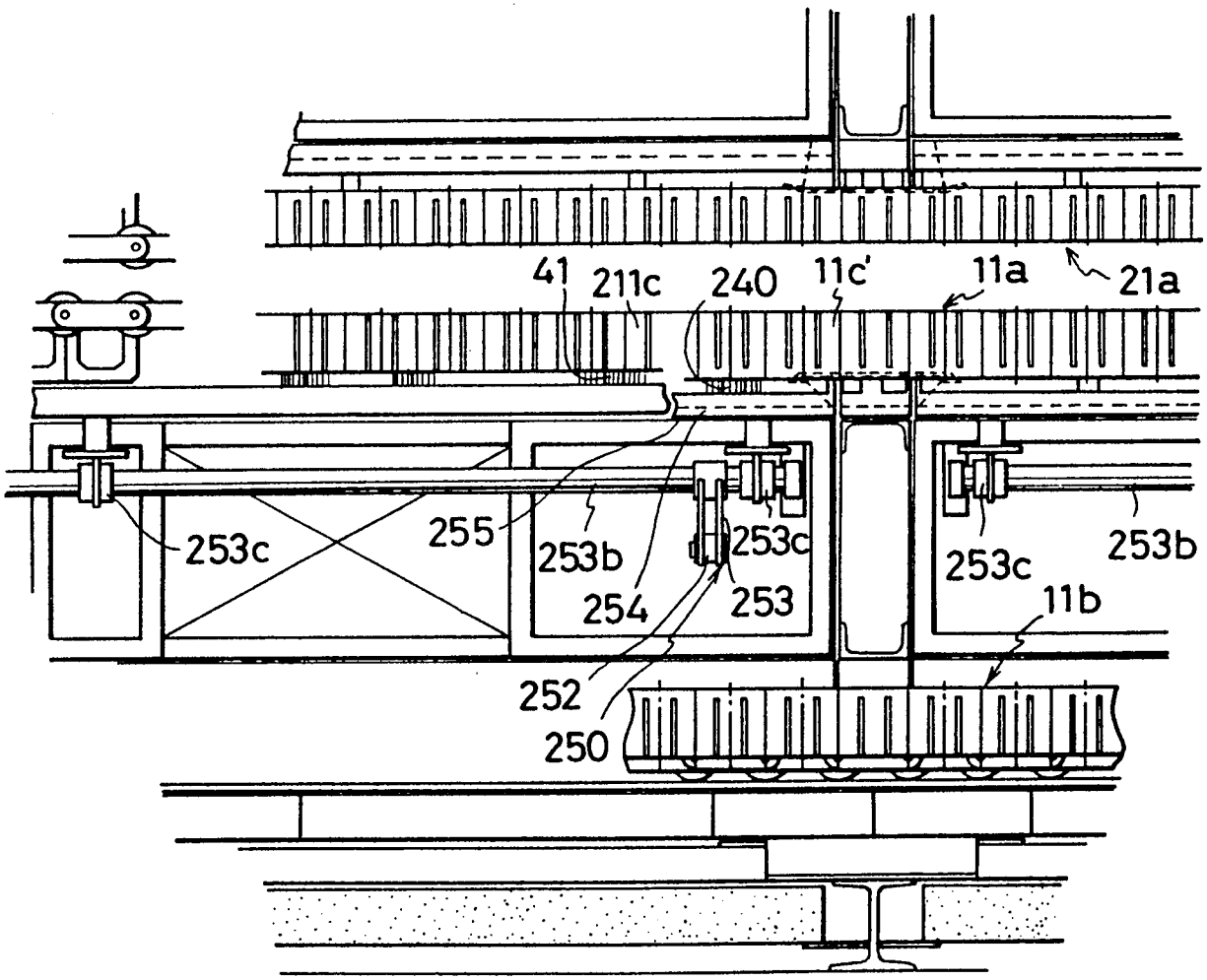
FIG. 8 is a cross section of the shield mechanism shown in FIG. 7, taken along the line VIII—VIII.

Considering the second wire brush 240, by way of example, it is located inwardly of the first wire brushes 41 and extends along the direction of conveyance, as shown in FIGS. 7 and 8. The rocking assembly 250 causes it to be rocked inwardly, whereby such brush can be moved toward or away from abutment against the plurality of reinforcing ribs 11*c*', 11*c*'' of the caterpillar plates 11*a* of the forward run. These wire brushes 41, 240 and 340 are designed to provide a self-sealing function by containing fine air gaps in its interior in which powder and particles (dusts) which may be developed during the drying and curing step may be trapped.

To illustrate the plurality of rocking assemblies 250, 350, FIGS. 8 and 9 illustrate one of them, the rocking assembly 250, for example, as comprising an air cylinder (or oil cylinder) 251 acting as an actuator, a rod 252 connected to the air cylinder 251 and extending through the oven 30 and reciprocable crosswise of the lower conveyor 1, a rocking arm 253 having its one end rockably connected to the rod 252 and fitted over an arm shaft 253*b*, and a rocking plate support member 253*c* also fitted over the arm shaft 253*b* and rocking integrally with the rocking arm 253. In addition, the rocking assembly 250 includes a rocking plate 254 which is mounted on the rocking plate support member 253*c* so as to extend along the direction of conveyance, with the second wire brush 240 mounted on the upper end of the rocking plate 254. A seal plate 255 is mounted on the rocking plate 254 so as to block the clearance between the opening edges 33*a*, 34*a* of the blowing boxes 33, 34 and the second wire brush 240.

Before the air cylinder 251 is actuated, the rocking assembly 250 causes the second wire brush 240 to be completely erect or upright so that it may be brought into abutment against the reinforcing rib 11*c*' of the caterpillar plate 11*a* of the forward run, thus sealing between the forward run 11*a* and the blowing boxes 33, 34. When the air cylinder 251 is actuated to cause the rod 252 to be displaced crosswise outwardly to thereby rock the rocking plate 254 integrally with the rocking arm 253, the second wire brush 240 which assumed an erect position is gradually turned or inclined inwardly for abutment against the reinforcing rib 11*c*'' of the caterpillar plate of the forward run 11*a*. As the air cylinder 251 continues to be actuated to cause a further displacement of the rod 252 outwardly, the second wire brush 240 will be toppled or laid down, and thus is moved away from either one of the reinforcing ribs 11*c*', 11*c*''.

The other rocking assembly 350 is constructed in the similar manner as the rocking assembly 250 mentioned above. Thus, it comprises an air cylinder 351, a rod 352, an arm shaft 353*b*, a rocking arm 353, a rocking plate support member 353*c*, a rocking plate 354 and a seal plate. However, the rod 352 has a different length dependent on the crosswise position of the third wire brush 340, and is vertically offset from the corresponding rod of the rocking assembly 250 in order to avoid an interference with the rod 252, the rocking arm 253 and the rocking plate 254 of the rocking assembly 250.

By causing a rocking motion of the second or third wire brushes 240, 340 to choose a shielded width as measured between given reinforcing ribs 211*c*, 11*c*', 11*c*'', 111*c*' and 111*c*'', the rocking assemblies 250, 350 are independently operated so as to bring either one of the first to the third wire brushes 41, 240, 340 into abutment against only the selected reinforcing ribs. For example, when the second wire brushes 240 are chosen to select a shielded width across the reinforcing ribs 11*c*', 11*c*', the rocking assembly 250 is operated to erect the second wire brush 240 to its upright position for abutment against the reinforcing rib 11*c*' of the caterpillar plate of the forward run 11*a* while the air cylinder 351 of the other rocking assembly 350 is operated to topple the third wire brushes 340 completely inwardly so that the latter may be moved away from the reinforcing ribs 111*c*', 111*c*'' of the caterpillar plates of the forward run 11*a*.

When choosing a shielded width defined by the first wire brushes 41, all of the air cylinders 251, 351 of the rocking assemblies 250, 350 are actuated to cause the second and the third wire brushes 240, 340 to be moved away from the reinforcing ribs 11*c*', 11*c*'', 111*c*', and 111*c*'', allowing only the first waved wire brushes 41 to be maintained in abutment against the reinforcing ribs 211*c*.

At this time, the second and the third wire brushes 240, 340 are only associated with the lower conveyor 1, but the hot air which is pumped to pass through the mat M is allowed to pass vertically therethrough, but hardly pass in the horizontal direction and allow a leakage of only the surplus waste gas, thereby avoiding the need to take the lateral path of the hot air from the lateral sides of the mat into consideration. This allows the sealing function to be fully exercised when the second and the third wire brushes 240, 340 are associated with the lower conveyor 1 alone. Once a waste gas is accumulated inside the oven 30, the waste gas is exhausted outside through the exhaust ducts 30*a*, 30*b*.

A method of manufacturing a mat for building purpose will now be described based on the operation of the apparatus mentioned above. Initially, an upper conveyor elevating mechanism 31 is used to adjust the upper conveyor 2 and the upper blowing boxes 33, 34 vertically in accordance with the thickness of a desired mat M, thus adjusting the inlet clearance defined between the caterpillar plates 11*a*, 21*a* of the both forward runs.

The effective width across which the mat M is to be subject to a drying/curing step is determined in accordance with the width of the mat M or a desired cutting pattern thereof, and suitable reinforcing ribs 11*c* are chosen in accordance with the effective width. By way of example, when the effective width is determined as corresponding to the shielded width across the reinforcing ribs 11*c*'', 11*c*'', the air cylinder 251 of the rocking assembly 250 is actuated to cause a crosswise outward displacement of the rod 252 through a given stroke, thus rocking the rocking plate 254 to bring the second wire brush 240 into abutment against the reinforcing rib 11*c*'', whereupon it is stopped.

The air cylinder 351 of the other rocking assembly 350 is then actuated to topple the third wire brushes 340 inwardly, thus moving them away from the reinforcing ribs 111*c*', 111*c*''. Since the effective width is selectable in accordance with the width of the mat M or a cutting pattern thereof by independently operating the rocking assemblies 250, 350 and choosing the desired reinforcing ribs 211*c*, 221*c*, 11*c*, 11*c*'', 111*c*' *and* 111*c*'', an area which is subject to an edge trim can be reduced, thus allowing the mat M to be manufactured in an efficient manner.

A drive from the drive source 22 is transmitted to the respective conveyors 1, 2, rotating the lower sprockets 3, 5 and the upper sprockets 13, 15 in opposite directions to each other, and the mat M is admitted between the conveyors 1, 2, and is conveyed therebetween while the opposite surfaces of the mat M are held between the surfaces 111, 121 of the caterpillar plates of the respective forward runs 11*a*, 21*a*. The speed of conveyance is variably controlled by the reduction gearing 23, which drives the conveyors 1, 2, in accordance with the material and the thickness of the mat M.

The hot air delivered from the heated blower unit 35 is pumped from the high pressure blowing box 33 disposed within the upper conveyor 2 through the ventilation openings 10 in the caterpillar plates of the forward run 21*a* to pass through the mat M being conveyed, thus drying and curing it. After working against the mat M, the hot air which then obtains a reduced temperature and a reduced pressure is then fed through the ventilation openings 10 formed in the caterpillar plate of the forward run 11*a* into the low pressure blowing box 34 disposed within the lower conveyor 1 to be returned to the heated blower unit 35, whereupon the air is again heated by the blower unit 35 to be pumped to the high pressure blowing box 33 associated with the lower conveyor 1, thus circulating through the hot air supply system.

During the drying/curing step, the space delineated by the high pressure and the low pressure blowing boxes 33, 34 and the caterpillar plates of the respective forward runs 11*a*, 21*a* is shielded by the first wire brushes 41 associated with the upper conveyor 2, and selected ones of the first to the third wire brushes 41, 240 and 340 associated with the lower conveyor 1, and hence the effective width of the mat M is determined by the shielded width across corresponding ones of the reinforcing ribs 211*c*, 11*c*', 11*c*'', 111*c*' and 111*c*'' on the caterpillar plates of the forward run 11*a* of the lower conveyor 1 against which the selected ones of the first to the third wire brushes 41, 240, 340 associated with the lower conveyor 1 abut.

In addition, during the drying/curing step of the mat M, powder and particles (dusts) which may be produced from the surface of the mat M as a result of the drying/curing process will find its way into the air gaps contained in the wire brushes 41, 240, 340 to be trapped therein. Accordingly, these wire brushes 41, 240, 340 themselves provide a self-sealing action to block a leakage of such powder or particles to the outside while simultaneously preventing the ingress of such dusts into the oven 30, thus mitigating the need for a maintenance operation of the apparatus. In addition, since air gaps contained in the wire brushes 41, 240, 340 are filled with powder or particles to improve the sealing performance, a constant pressure of the hot air can be assured around the full perimeter of the mat, thus allowing an even drying/curing upon completion of the conveyance. This enhances the thermal efficiency and allows a reduction in the cost involved.

In the embodiment described above, two rows of movable wire brushes have illustrates as the second and the third wire brush 240, 340, but it should be understood that the provision of wire brushes is not limited thereto, but that a plurality of rows, more than two, of wire brushes may be provided depending on the size of the manufacturing apparatus and disposed as displaced inwardly of the first wire brushes at successively offset crosswise positions so as to avoid an interference therebetween while extending along the direction of conveyance and rocked independently of other rows by associated rocking assemblies to achieve a similar effect.

In the described embodiment, the wire brushes have been chosen as the flexible caulking member, but it should be understood that such member is not limited thereto, but may comprise any fibrous body which has a heat resistance and which exhibits a self-sealing function.

Further, in the above-described embodiment, the wire brushes have been chosen, but may be replaced by waved wire brushes whose wires are formed in metal and have the shape of wave. Using of the waved wire brushes improves a trap performance more preferable.

In addition, when the hot air which is pumped from the heated blower unit has a low temperature, the wire brushes may be replaced by nylon wire brushes.

While the embodiment has been mentioned above in connection with a mat for building purpose such as a mat of fibrous or powder material, the invention is not limited thereto, but is equally applicable to a non-dry material such as thermosetting resin.

While the invention has been disclosed above in connection with a preferred embodiment thereof, it should be understood that a number of changes, modifications and substitutions therein will readily occur to one skilled in the art from the above disclosure without departing from the spirit and scope of the invention defined by the appended claims.

What is claimed is:

1. A method of manufacturing a mat comprising the steps of:

conveying a mat in a conveying direction between a first and a second conveyor, the second conveyor being disposed above the first conveyor;

feeding hot air from a blower source to at least one of a first blower box and a second blower box, the first blower box being disposed below a conveying surface of the first conveyor and the second blower box being disposed above a conveying surface of the second conveyor;

forcing the hot air to pass from said at least one of the first and second blower boxes through the conveying surfaces of the first and second conveyors and the mat to the other of said first and second blower boxes to dry and cure the mat; and preventing the hot air from leaking out from between the blower boxes and the respective conveyors by utilizing a shielding mechanism, the shielding mechanism including stationary caulking members interposed between the respective blower boxes and the conveyors, the stationary caulking members extending in the conveying direction and being spaced-apart in a first direction transverse to the conveying direction, the shielding mechanism further including a movable flexible caulking member disposed inwardly of the stationary caulking members in the first direction and being displaceable between a shielding position and a non-shielding position to provide a variable shielding width.

2. The method according to claim 1, wherein the stationary caulking members are positioned laterally away from the mat in the first direction and disposed outside a path of conveyance, and the shielding means includes a plurality of movable flexible caulking members disposed inwardly of the stationary caulking members in the first direction, the plurality of movable flexible caulking members being independently displaceable between the shielding position and the non-shielding position.

3. An apparatus for manufacturing a mat, the apparatus comprising:

means for conveying the mat through an oven in a forward conveying direction and including a first conveyor and a second conveyor disposed above the first conveyor, each conveyor having a pair of endless chains spaced apart in a first direction transverse to the conveying direction and a plurality of strut plates extending in the first direction between the respective pairs of chains, each strut plate having a plurality of ventilation openings formed therein, the mat being conveyed in the forward conveying direction between a forward traveling run of each of the first and second conveyors;

a heated source for supplying heated air;

means for drying and curing the mat as it is conveyed in the forward conveying direction and including a plurality of blower boxes disposed below and above the respective forward traveling runs of the first and the second conveyors, whereby the hot air from the heated source is caused to be circulated from one of the blower boxes through the ventilation openings in the strut plates of the respective forward traveling runs and through the mat to another one of the blower boxes;

shielding means for preventing the hot air from leaking out from between the means for drying and curing and the respective forward traveling runs, the shielding means including stationary caulking members extending in the forward conveying direction and abutting a respective end of the strut plates of the respective forward traveling runs, and a plurality of movable flexible caulking members disposed inwardly of the stationary caulking members in the first direction, each movable caulking member extending in the forward conveying direction and being movable toward and away from the strut plates of the respective forward traveling runs; and shielding width selection means for operating the movable flexible caulking members to provide a variable shielding width which permits drying and curing the mat to a selectable effective width.

4. The apparatus according to claim 3, wherein the plurality of movable flexible caulking members are disposed inwardly of the stationary caulking members at different crosswise positions, and the shielding width selection means operates each of the plurality of movable flexible caulking members independently so that the variable shielding width is determined by the stationary and movable caulking members abutting against the strut plates of the respective forward traveling runs.

5. The apparatus according to claim 4, wherein the shielding width selection means includes a plurality of rocker assemblies, each of which is operable to rock an associated one of the plurality of movable flexible caulking members independently for movement toward and away from abutment against the strut plates of the respective forward traveling runs.

6. The apparatus according to claim 5, wherein each of the rocker assemblies comprises an actuator, a rod connected to the actuator and extending through a lower portion of the oven and being reciprocable crosswise of the first conveyor, a rocker arm rockably connected to the rod and fitted on an arm shaft, and a rocker plate connected to the arm shaft through a support member so as to be integrally movable with the rocker arm and extending in the conveying direction, the rocker plate supporting one of the movable flexible caulking members on a top end thereof.

7. The apparatus according to claim 3, wherein each of the flexible caulking members includes a wire brush.

* * * * *